US008701417B2

(12) United States Patent
Nicholls et al.

(10) Patent No.: US 8,701,417 B2
(45) Date of Patent: Apr. 22, 2014

(54) HEAD PART OF AN ANNULAR COMBUSTION CHAMBER

(75) Inventors: Andrew Nicholls, Burton on Trent (GB); Michael L Carlisle, Derby (GB); Ian M Garry, Thurcaston (GB); Michael N Wybrow, Nottingham (GB)

(73) Assignee: Rolls-Royce PLC, London (GB)

( * ) Notice: Subject to any disclaimer, the term of this patent is extended or adjusted under 35 U.S.C. 154(b) by 0 days.

(21) Appl. No.: 13/450,943

(22) Filed: Apr. 19, 2012

(65) Prior Publication Data

US 2012/0272652 A1 Nov. 1, 2012

(30) Foreign Application Priority Data

Apr. 28, 2011 (GB) ..... 1107095.0

(51) Int. Cl.
*F02C 1/00* (2006.01)

(52) U.S. Cl.
USPC ..... 60/756; 60/796

(58) Field of Classification Search
CPC ..... F23R 2900/00017; F23R 2900/03041; F23R 2900/03042
USPC ..... 60/752–760, 796, 804
See application file for complete search history.

(56) References Cited

U.S. PATENT DOCUMENTS 5,222,358 A * 6/1993 Chaput et al. ..... 60/796
5,509,270 A * 4/1996 Pearce et al. ..... 60/740
5,894,732 A 4/1999 Kwan
5,956,955 A 9/1999 Schmid
5,996,335 A 12/1999 Ebel
7,673,460 B2 * 3/2010 Hernandez et al. ..... 60/796
7,845,174 B2 * 12/2010 Parkman et al. ..... 60/756
2002/0178734 A1 12/2002 Stastny
2008/0115499 A1 5/2008 Patel et al.
2008/0236169 A1 10/2008 Hawie et al.

FOREIGN PATENT DOCUMENTS

EP 1 975 514 A2 10/2008
GB 2 287 310 A 9/1995

OTHER PUBLICATIONS

British Search Report issued in Application No. 1107095.0; Dated Aug. 17, 2011.

* cited by examiner

*Primary Examiner* — Phutthiwat Wongwian
(74) *Attorney, Agent, or Firm* — Oliff PLC

(57) ABSTRACT

A head part of an annular gas turbine combustion chamber including: an end wall with a passage opening for accommodating a burner, the end wall including a set back portion adjacent the passage opening; a heat shield covering a back side of the end wall which faces towards the combustion chamber, the heat shield including a protruding portion shaped to cooperate with the set back portion of the end wall; and a burner collar adapted to fit within the passage opening and receive a burner, the burner collar including a protruding portion radially protruding from an outer surface of the burner collar; wherein the head part of the annular gas turbine combustion chamber is configured such that in an installed configuration the protruding portion of the burner collar is held between the protruding portion of the heat shield and the set back portion of the end wall.

13 Claims, 5 Drawing Sheets

Related Art

Related Art

HEAD PART OF AN ANNULAR COMBUSTION CHAMBER

CROSS-REFERENCE TO RELATED APPLICATIONS

This application is based upon and claims the benefit of priority from British Patent Application Number 1107095.0 filed 28 Apr. 2011, the entire contents of which are incorporated by reference.

BACKGROUND OF THE INVENTION

1. Field of the Invention

The present disclosure relates to a head part of an annular combustion chamber and particularly but not exclusively relates to a head part of an annular gas turbine combustion chamber for a gas turbine.

2. Description of the Related Art

The operation of gas turbine engines is relatively well known and, as will be appreciated, requires presentation of fuel for combustion in order to generate thrust. In order to present that fuel, a fuel spray nozzle or burner is required. Referring to FIG. 1(*a*), which shows a first previously-proposed arrangement, the fuel burner (not shown) is typically located within an end wall or meter panel 10 such that the fuel spray is appropriately presented within the combustor parts of the gas turbine engine. It will be understood that the combustor parts of a gas turbine engine will generate significant heat and therefore thermal stressing as well as vibration and other factors may create significant wear upon the mountings for the spray nozzle. In such circumstances a burner collar 30 is generally provided within the end wall 10 which ensures that the fuel spray nozzle is appropriately presented. A heat shield 20 is also provided to protect the end wall 10 from the hot burner gases and from an unacceptably high radiation effect. Furthermore, upon repair and overhaul it is generally easier to replace the heat shield 20 rather than the end wall 10 within the gas turbine engine.

FIGS. 1(*b*) and 1(*c*) show similar head parts of an annular combustion chamber for second and third previously-proposed arrangements. Further examples are shown in U.S. Pat. No. 5,996,335, EP1975514, U.S. Pat. No. 5,956,955 and U.S. Pat. No. 5,894,732.

In each example, the burner collars 30 and hence burners are held in place by virtue of a holding part 22, which is fastened to the end wall 10 together with the heat shield 20.

In the case of the first previously-proposed arrangement shown in FIG. 1(*a*), the holding part 22 secures the burner collar 30 to the end wall 10 by virtue of a bolt tack welded to a washer 23. A location ring 12 is provided between the collar 30 and end wall 10. In the second previously-proposed arrangement, the burner collar 30 is held between two retaining washers 34, 36, which are in turn held in place by the heat shield 20 and holding part 22. The burner collar 30 of the third previously-proposed arrangement is held in place by a common holding part 22 shared between adjacent burner collars 30.

However, the previously-proposed arrangements require an excessive number of components, which add to the cost and weight of the combustor. Furthermore, additional time is required to assemble and dissemble the components, e.g. on first build or during an overhaul, and this further adds to the costs. On the first and third previously-proposed arrangements the head components can only be assembled from the cold side of the end wall, i.e. the side not facing the combustion chamber, which is less convenient to access. With the first and third previously-proposed arrangements the location ring 12 and burner collar 30 have to be "posted" through a slot (not shown) in the cowl and passed around the space between the cowl and the meter panel to the required burner position. This further complicates the installation process and adds weight to the cowl since the slot requires a cover plate and rivets.

Furthermore, in the case of the first and third previously-proposed arrangement, the components for each burner position have to be assembled or disassembled in sequence. For example, to remove the tenth burner seal/location ring, then the first to ninth burner seals have to be removed first.

The present disclosure therefore seeks to address these issues.

OBJECTS AND SUMMARY OF THE INVENTION

According to a first aspect of the present invention there is provided a head part of an annular combustion chamber for a gas turbine, the head part comprising: an end wall with a passage opening for accommodating a burner, the end wall comprising a set back portion adjacent the passage opening; a heat shield covering a back side of the end wall which faces towards the combustion chamber, the heat shield comprising a protruding portion shaped to cooperate with the set back portion of the end wall; and a burner collar adapted to fit within the passage opening and receive the burner, the burner collar comprising a protruding portion radially protruding from an outer surface of the burner collar; wherein the head part of the annular combustion chamber is configured such that in an installed configuration the protruding portion of the burner collar is held between the protruding portion of the heat shield and the set back portion of the end wall.

The set back portion of the end wall adjacent the passage opening may be set back from the remainder of the end wall. The protruding portion of the burner collar may be received on the set back portion of the end wall. The set back portion of the end wall may be formed by a notch in a perimeter wall defining the passage opening. The notch may be adapted to receive the protruding portion of the burner collar and/or protruding portion of the heat shield.

The set back portion of the end wall may be formed at least in part by a protrusion provided on the perimeter wall defining the passage opening. The set back portion of the end wall may be formed at least in part by a protrusion provided on a front side of the end wall, the front side facing away from the combustion chamber. The protrusion forming the set back portion may, at least partially, extend radially inward with respect to the passage opening. The protrusion forming the set back portion may extend about the circumference of the perimeter wall.

The protruding portion of the burner collar may extend about the perimeter of the burner collar. The protruding portion of the burner collar may define an annular rim.

The burner collar may be insertable into the passage opening from the combustion chamber side of the end wall.

The end wall passage opening and/or burner collar, e.g. the burner collar protruding portion, may be configured to permit relative radial movement between the burner collar and the end wall. For example, the diameter of the passage opening at the notch may be greater than the diameter of the burner collar protruding portion. The diameter of the passage opening at the protrusion forming the set back portion may be greater than the diameter of the burner collar.

The heat shield may comprise an opening corresponding to the passage opening. The heat shield protruding portion may be disposed about a perimeter of the heat shield opening.

The protruding portion of the burner collar may be in direct contact with the heat shield, e.g. the heat shield protruding portion, and/or the set back portion of the end wall adjacent the passage opening.

One or more lugs may be provided on the heat shield and/or end wall. The protruding portion of the burner collar may comprise one or more corresponding openings for receiving the lugs. Alternatively, or additionally, one or more openings may be provided on the heat shield and/or end wall. The protruding portion of the burner collar may comprise one or more corresponding lugs for cooperating with the openings. The lugs and openings may prevent rotation of the burner collar relative to the end wall.

A combustion chamber may comprise the above-mentioned head part of the annular combustion chamber. A gas turbine engine may comprise the above-mentioned head part of the annular combustion chamber.

According to a second aspect of the present invention there is provided a method of installing a burner collar of a head part of an annular combustion chamber for a gas turbine, the head part comprising: an end wall with a passage opening for accommodating a burner, the end wall comprising a set back portion adjacent the passage opening; a heat shield covering a back side of the end wall which faces towards the combustion chamber, the heat shield comprising a protruding portion shaped to cooperate with the set back portion of the end wall; and the burner collar adapted to fit within the passage opening and receive a burner, the burner collar comprising a protruding portion radially protruding from an outer surface of the burner collar; wherein the method comprises placing the protruding portion of the burner collar between the protruding portion of the heat shield and the set back portion of the end wall such that the burner collar is held in place with respect to the end wall.

According to a third aspect of the present invention there is provided a head part of an annular combustion chamber for a gas turbine, the head part comprising: an end wall with a passage opening for accommodating a burner; a heat shield covering a back side of the end wall which faces towards the combustion chamber; and a burner collar adapted to fit within the passage opening and receive the burner, the burner collar comprising a protruding portion radially protruding from an outer surface of the burner collar; wherein the head part of the annular combustion chamber is configured such that in an installed configuration the protruding portion of the burner collar is held between the heat shield and a portion of the end wall adjacent the passage opening such that the protruding portion of the burner collar is in direct contact with the heat shield and/or the portion of the end wall adjacent the passage opening.

According to a fourth aspect of the present invention there is provided a method of installing a burner collar of a head part of an annular combustion chamber for a gas turbine, the head part comprising: an end wall with a passage opening for accommodating a burner; a heat shield covering a back side of the end wall which faces towards the combustion chamber; and the burner collar adapted to fit within the passage opening and receive a burner, the burner collar comprising a protruding portion radially protruding from an outer surface of the burner collar; wherein the method comprises placing the protruding portion of the burner collar between the heat shield and the portion of the end wall such that the burner collar is held in place with the protruding portion of the burner collar in direct contact with the heat shield and/or the portion of the end wall adjacent the passage opening.

BRIEF DESCRIPTION OF THE DRAWINGS

For a better understanding of the present disclosure, and to show more clearly how it may be carried into effect, reference will now be made, by way of example only, to the accompanying drawings, in which.

DETAILED DESCRIPTION OF THE PREFERRED EMBODIMENTS

Figure 1A:
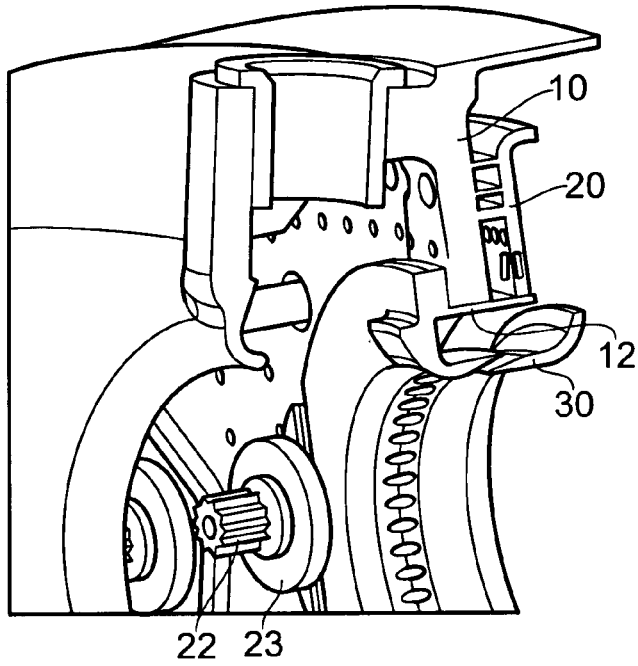
FIG. 1(a) Related Art
FIGS. 1(*a*), (*b*) and (*c*) show first, second and third previously-proposed head parts of an annular gas turbine combustion chamber.
Figure 1B:
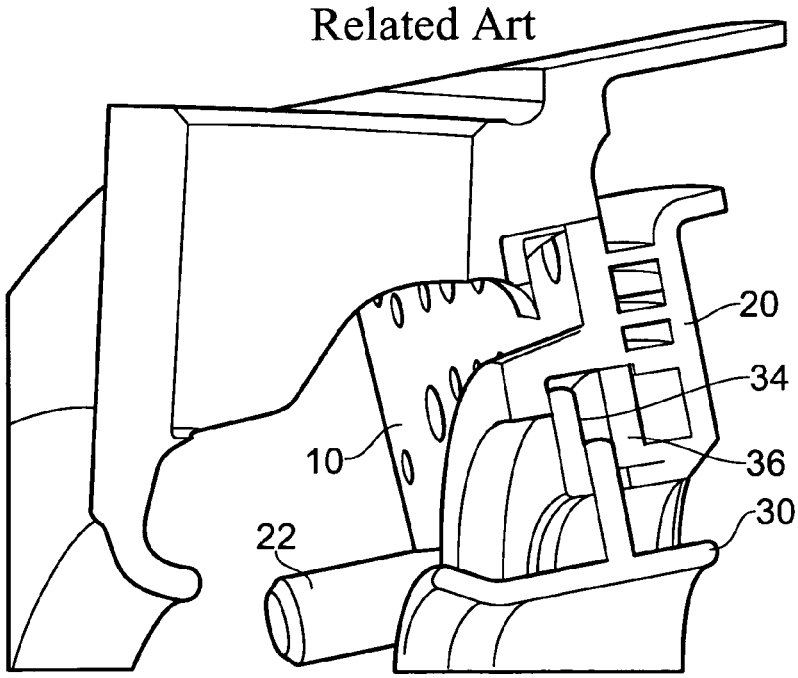
Figure 1C:
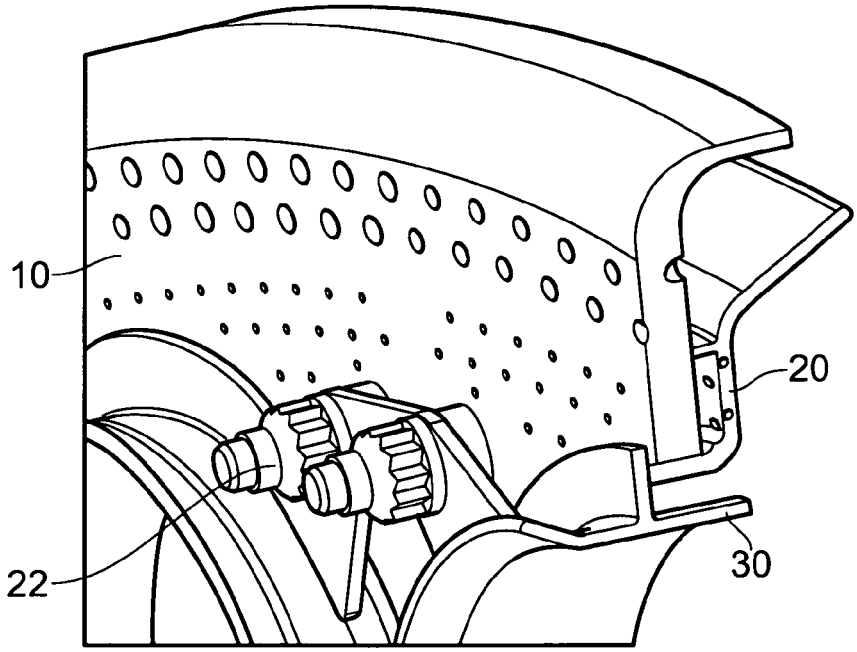
Figure 2A:
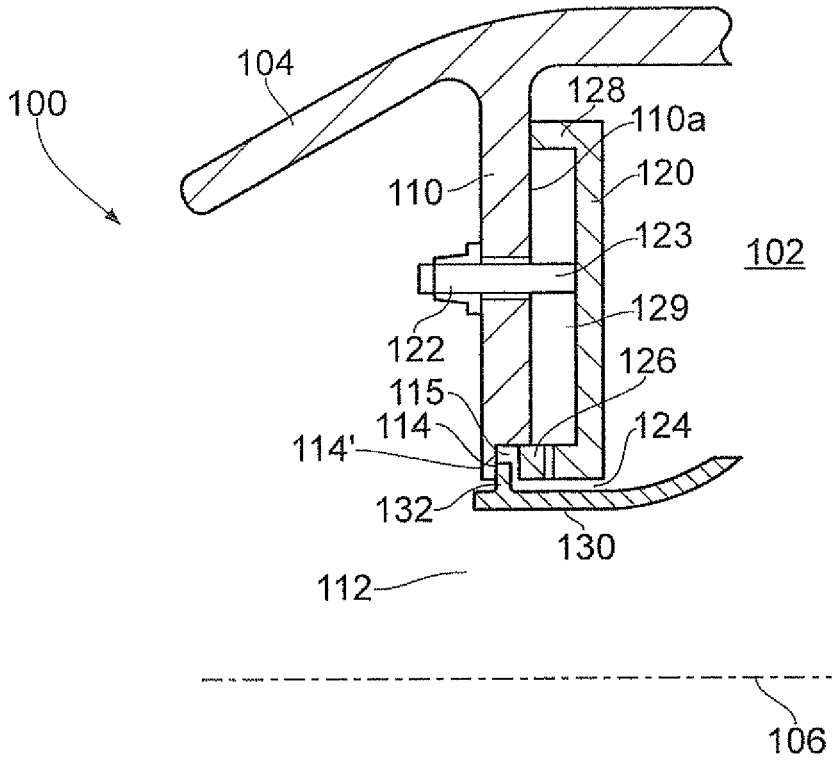
FIG. 2 shows a sectional view of a head part of an annular combustion chamber according to a first example of the present disclosure with FIG. 2(*b*) showing a magnified view of part of FIG. 2(*a*)
Figure 2A:
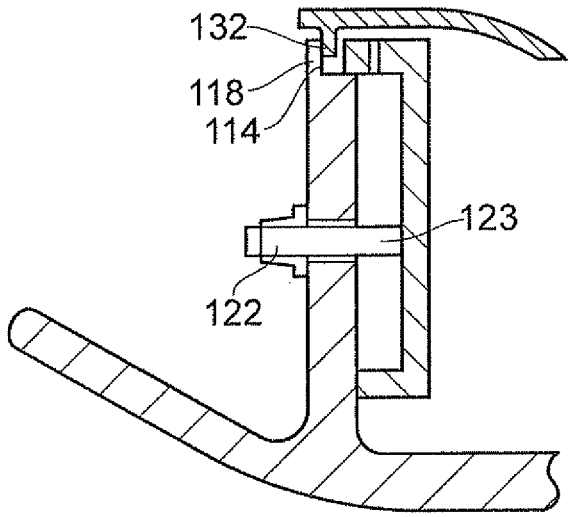
Figure 2B:
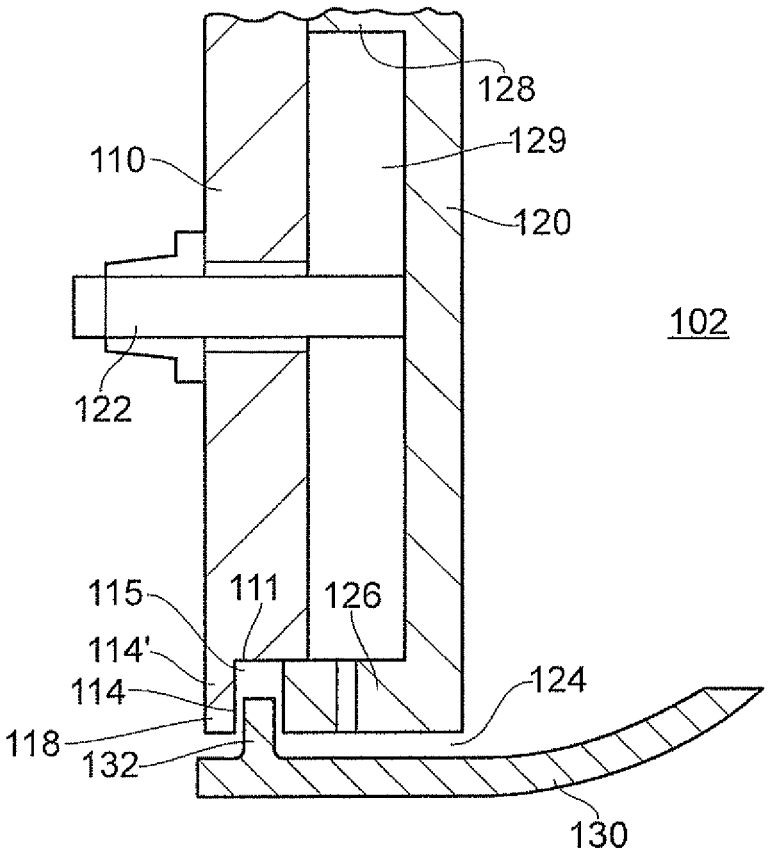

With reference to FIGS. 2(*a*) and 2(*b*), a head part 100 of an annular gas turbine combustion chamber 102, according to a first example of the present disclosure, may comprise a dome-type wall 104 and an end wall or meter panel 110 which may act as a supporting wall. The end wall 110 may comprise a passage opening 112 for accommodating a burner (not shown). The dome-type wall 104 may form a body of revolution about an axis 106 and each burner may have a dome-type wall associated with it. By contrast, the end wall 110 may form a body of revolution about a longitudinal axis of the gas turbine (not shown). To this extent, this annular combustion chamber corresponds to the known state of the art. Also in a known manner, several burners project in a circularly arranged manner into the annular combustion chamber 102, by way of which fuel as well as combustion air may be charged in a swirled manner into the combustion chamber.

The head part 100 may also comprise a heat shield 120 covering a back side 110*a* of the end wall 110 which faces towards the combustion chamber 102. The heat shield 120 may protect the end wall 110, as well as the dome-type wall 104, from the hot burner gases and from an unacceptably high radiation effect. This heat shield 120 may be fastened with securing means, e.g. studs 123 which are integral with the heat shield 120 and nuts 122, to the end wall 110 and has a through-hole 124 for the burner.

The burner (not shown) may be surrounded by a sealing part or collar 130, which may ensure that a large portion of the combustion air supplied through the passage opening 112 in the dome-type wall 104 flows into the combustion chamber 102 by way of the burner. Accordingly, the head part 100 may further comprise the burner collar 130 adapted to fit within the passage opening 112 of the end wall 110 and through-hole 124 of the heat shield 120.

The burner collar 130 may comprise a protruding portion 132 radially protruding from an outer surface of the burner collar 130. The protruding portion 132 of the burner collar 130 may be adapted to be held between the heat shield 120 and a portion 114 of the end wall 110 adjacent the passage opening 112 such that the burner collar 130 may be held in place with respect to the end wall 110. The protruding portion 132 of the burner collar 130 may be in direct contact with the heat shield 120 and/or portion 114 of the end wall 110 adjacent the passage opening 112. The protruding portion 132 of the burner collar 130 may extend about the perimeter of the burner collar 130. The protruding portion 132 of the burner collar 130 may define an annular rim.

The portion 114 of the end wall 110 adjacent the passage opening 112 may be integral, e.g. unitary, with the remainder of the end wall 110. The portion 114 of the end wall 110 adjacent the passage opening 112 may be set back from the back side 110*a* of the end wall 110 so as to form a set back portion 114' of the end wall 110. The protruding portion 132 of the burner collar 130 may be received on the set back portion 114' of the end wall 110. The set back portion 114' of the end wall 110 may be formed by a notch 115 in a perimeter wall 111 of the end wall 110 defining the passage opening 112. The notch 115 may be adapted to receive the protruding portion 132 of the burner collar 130. Alternatively or additionally, the set back portion 114' of the end wall 110 may be formed at least in part by a protrusion 118 provided on the perimeter wall 111 defining the passage opening 112. The protrusion 118 forming the set back portion may extend radially inwardly with respect to the passage opening 112. The notch 115 and/or protrusion 118 forming the set back portion 114' may extend about the circumference of the perimeter wall 111.

The heat shield 120 may comprise a protruding portion 126 shaped to cooperate with the portion 114 of the end wall 110 adjacent the passage opening 112, e.g. the set back portion 114' of the end wall 110. For example, the protruding portion 126 of the heat shield 120 may fit inside the notch 115. The heat shield protruding portion 126 may be disposed about a perimeter of the heat shield opening 124. By virtue of the cooperation between the protruding portion 126 and the portion 114 of the end wall 110 adjacent the passage opening 112, the heat shield 120 may be self locating with respect to the end wall 110.

In addition to the protruding portion 126, the heat shield 120 may also be provide with a further protruding portion 128 at an outer edge of the heat shield 120. The protruding portions 126, 128 may together hold the remainder of the heat shield 130 away from the end wall 110 so that a gap 129 is provided therebetween.

To accommodate build tolerances and thermal growths the end wall passage opening 112 and/or burner collar 130 may be configured to permit limited relative radial movement between the burner collar 130 and the end wall 110. For example, the diameter of the passage opening 112 at the notch 115 may be greater than the diameter of the burner collar 130 protruding portion 132. Equally, the diameter of the passage opening 112 at the protrusion forming the set back portion 114' may be greater than the diameter of the burner collar 130. However, the diameter of the burner collar 130 protruding portion 132 may be greater than the diameter of the passage opening 112 at the protrusion forming the set back portion, thereby ensuring that, despite any radial movement, no gap may occur between the end wall 110 and the burner collar 130.

The burner collar 130 may be installed by placing the protruding portion 132 of the burner collar 130 on the portion 114 of the end wall adjacent the passage opening 112. Since the set back portion 114' of the end wall 110 is set back from the back side 110*a* of the end wall 110, the burner collar may 130 be inserted into the passage opening 112 from the combustion chamber 102 side of the end wall 110. The heat shield 120 may then be secured to the end wall 110 by virtue of the studs 122 and the protruding portion 132 may be held between the heat shield 120 and the portion 114 of the end wall 110 adjacent the passage opening 112.

Figure 3:
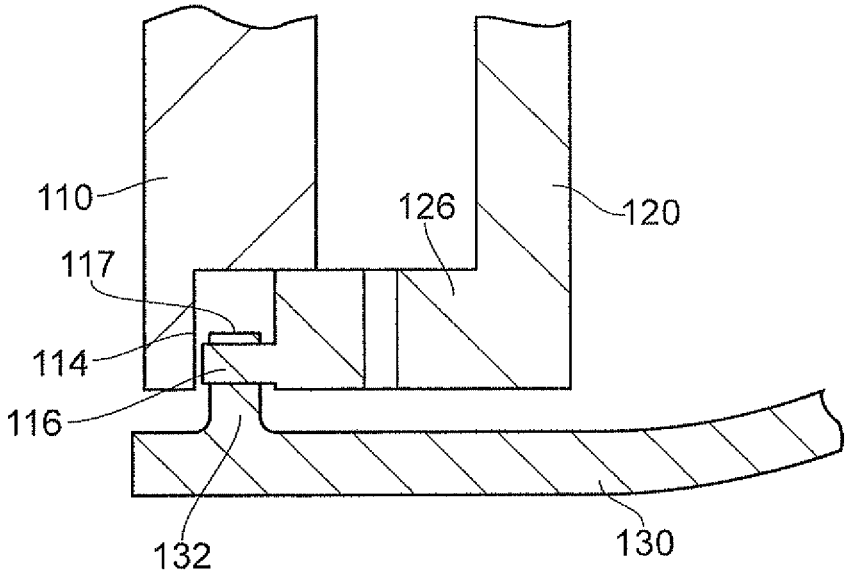
FIG. 3 shows a sectional view of a head part of an annular combustion chamber according to a second example of the present disclosure.

With reference to FIG. 3, in a second example of the present disclosure, one or more lugs 116 may optionally be provided on the heat shield 120 and/or end wall 110. The lugs 116 may be provided on a front facing side of the heat shield 120 (e.g. facing away from the combustion chamber 102) and/or on a back facing side of the end wall 110 (e.g. facing the combustion chamber 102). The lugs 116 may be provided on the heat shield protruding portion 126 and/or the portion 114 of the end wall 110 adjacent the passage opening 112. The protruding portion 132 of the burner collar 130 may comprise one or more corresponding openings 117 for receiving the lugs 116. Alternatively, the lugs 116 may be provided on the protruding portion 132 of the burner collar 130 and the heat shield 120 and/or end wall 110 may be provided with the corresponding openings. The lugs 116 and corresponding openings may prevent rotation of the burner collar 130 relative to the end wall 110.

Figure 4:
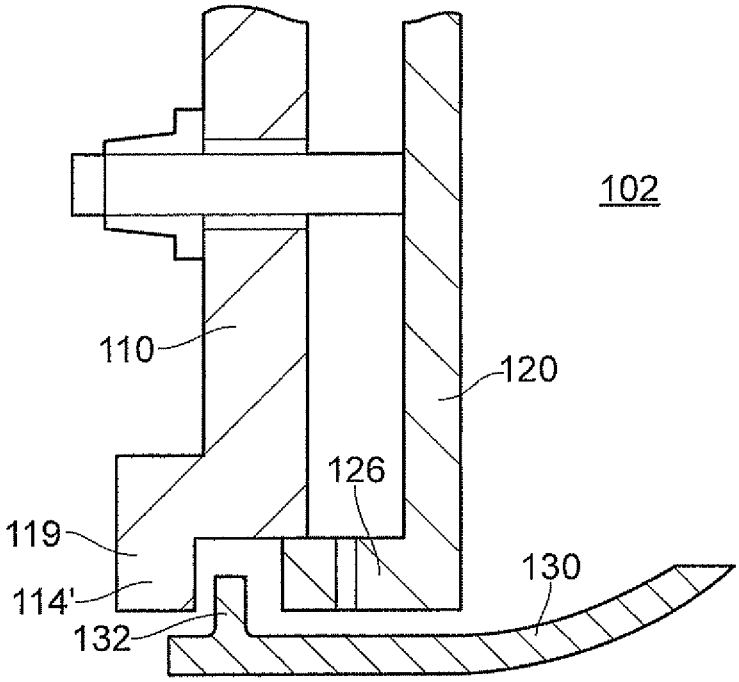
FIG. 4 shows a sectional view of a head part of an annular combustion chamber according to a third example of the present disclosure.

With reference to FIG. 4, in a third example of the present disclosure, the set back portion 114' of the end wall 110 may be formed at least in part by a protrusion 119 provided on a front side of the end wall 110, e.g. facing away from the combustion chamber 102. The protrusion 119 may, at least partially, extend radially inwardly with respect to the passage opening 112 and the protrusion 119 may extend about the circumference of the perimeter wall 111. The third example of the present disclosure is otherwise the same as the first example, for example, the protruding portion 132 of the burner collar 130 may be held between the heat shield 120 protruding portion 126 and the set back portion 114' of the end wall 110. It may also be possible to provide lugs on the heat shield 120 or end wall 110 in a similar manner to that described with reference to the second example in FIG. 3.

The present disclosure advantageously reduces the part count compared to the previously proposed arrangements. For example, the location rings and burner seal retaining features (e.g. two bolt and washer assemblies per burner position) of the previously-proposed arrangements are eliminated. Furthermore, the "letter box" slot in the cowl together with the associated cover plate and rivets are no longer required with the present disclosure. This significantly reduces the cost and weight of the design.

In addition the component parts of the present disclosure are significantly easier to assemble. For example, two drilling and assembly operations required for the previously-proposed arrangements (e.g. associated with the two bolt and washer assemblies per burner position) are eliminated. Furthermore, the components at each individual burner position can be removed and/or assembled independently of other burner positions, in contrast with the previously-proposed arrangements where they all have to be assembled or dissembled in sequence. Assembly time and cost are thus reduced not only on construction but also at overhaul.

We claim:

1. A head part of an annular combustion chamber for a gas turbine, the head part comprising:

an end wall comprising a perimeter wall defining a passage opening for accommodating a burner, the end wall comprising a set back portion adjacent to the passage opening, the set back portion extends inward of the perimeter wall;

a heat shield covering a back side of the end wall which faces towards the combustion chamber, the heat shield comprising a protruding portion shaped to cooperate with the set back portion of the end wall; and a burner collar adapted to fit within the passage opening and receive the burner, the burner collar comprising a protruding portion radially protruding from an outer surface of the burner collar, wherein:

the head part of the annular combustion chamber is configured such that in an installed configuration (1) the protruding portion of the heat shield directly engages with the perimeter wall of the end wall, and (2) the protruding portion of the burner collar is held between the protruding portion of the heat shield and the set back portion of the end wall.

2. The head part of an annular combustion chamber as claimed in claim 1, wherein the set back portion of the end wall is formed by a notch in a perimeter wall defining the passage opening.

3. The head part of an annular combustion chamber as claimed in claim 1, wherein the set back portion of the end wall is formed at least in part by a protrusion provided on a perimeter wall defining the passage opening.

4. The head part of an annular combustion chamber as claimed in claim 1, wherein the set back portion of the end wall is formed at least in part by a protrusion provided on a front side of the end wall, the front side facing away from the combustion chamber.

5. The head part of an annular combustion chamber as claimed in claim 1, wherein the protruding portion of the burner collar is in direct contact with the protruding portion of the heat shield and/or the set back portion of the end wall adjacent the passage opening.

6. The head part of an annular combustion chamber as claimed in claim 1, wherein the protruding portion of the burner collar extends about a perimeter of the burner collar.

7. The head part of an annular combustion chamber as claimed in claim 1, wherein the protruding portion of the burner collar defines an annular rim.

8. The head part of an annular combustion chamber as claimed in claim 1, wherein the burner collar is insertable into the passage opening from a combustion chamber side of the end wall.

9. The head part of an annular combustion chamber as claimed in claim 1, wherein the end wall passage opening and/or burner collar are configured to permit relative radial movement between the burner collar and the end wall.

10. The head part of an annular combustion chamber as claimed in claim 1, wherein one or more lugs and/or openings are provided on the heat shield and/or end wall, the protruding portion of the burner collar comprising one or more corresponding lugs and/or openings for cooperating with the corresponding lugs or openings, the lugs and openings preventing rotation of the burner collar relative to the end wall.

11. A combustion chamber comprising the head part of the annular combustion chamber as claimed in claim 1.

12. A gas turbine engine comprising the head part of the annular combustion chamber as claimed in claim 1.

13. A method of installing a burner collar of a head part of an annular combustion chamber for a gas turbine, the head part comprising:

an end wall comprising a perimeter wall defining a passage opening for accommodating a burner, the end wall comprising a set back portion adjacent to the passage opening, the set back portion extends inward of the perimeter wall;

a heat shield covering a back side of the end wall which faces towards the combustion chamber, the heat shield comprising a protruding portion shaped to cooperate with the set back portion of the end wall; and a burner collar adapted to fit within the passage opening and receive the burner, the burner collar comprising a protruding portion radially protruding from an outer surface of the burner collar;

wherein the method comprises (1) directly engaging the protruding portion of the heat shield with the perimeter wall of the end wall, and (2) placing the protruding portion of the burner collar between the protruding portion of the heat shield and the set back portion of the end wall such that the burner collar is held in place with respect to the end wall.

* * * * *